United States Patent [19]

Dower

[11] 4,000,645

[45] Jan. 4, 1977

[54] APPARATUS FOR PNEUMATICALLY MONITORING CONDITIONS OF A WELL CIRCULATING SYSTEM

[75] Inventor: Ethell J. Dower, Houston, Tex.

[73] Assignee: Warren Automatic Tool Co., Houston, Tex.

[22] Filed: June 6, 1975

[21] Appl. No.: 584,613

[52] U.S. Cl. ..... 73/155; 137/608; 137/624.18

[51] Int. Cl.[2] ..... E21B 47/10

[58] Field of Search ..... 73/155, 168; 137/608, 137/624.18; 235/201 ME; 175/48

[56] References Cited

UNITED STATES PATENTS

| | | | |
|---|---|---|---|
| 3,070,295 | 12/1962 | Glattli | 235/201 ME UX |
| 3,602,322 | 8/1971 | Gorsuch | 73/155 X |
| 3,726,136 | 4/1973 | McKean et al. | 73/155 |

*Primary Examiner*—Jerry W. Myracle
*Attorney, Agent, or Firm*—Arnold, White & Durkee

[57] ABSTRACT

Pneumatic apparatus for monitoring conditions of the drilling fluid circulating system of a well being drilled. A pneumatic signal having unequal duration times and representative of the rate of movement of the circulating pump is transmitted through a repeater valve and converted by a frequency divider into a pair of pneumatic signals having equal duration times. These signals actuate a series of metering systems which generate rate pressures representative of conditions of the circulating system. These rate pressures are displayed to the operator through independently calibrated and adjusted gauges.

26 Claims, 6 Drawing Figures

FIG. 1
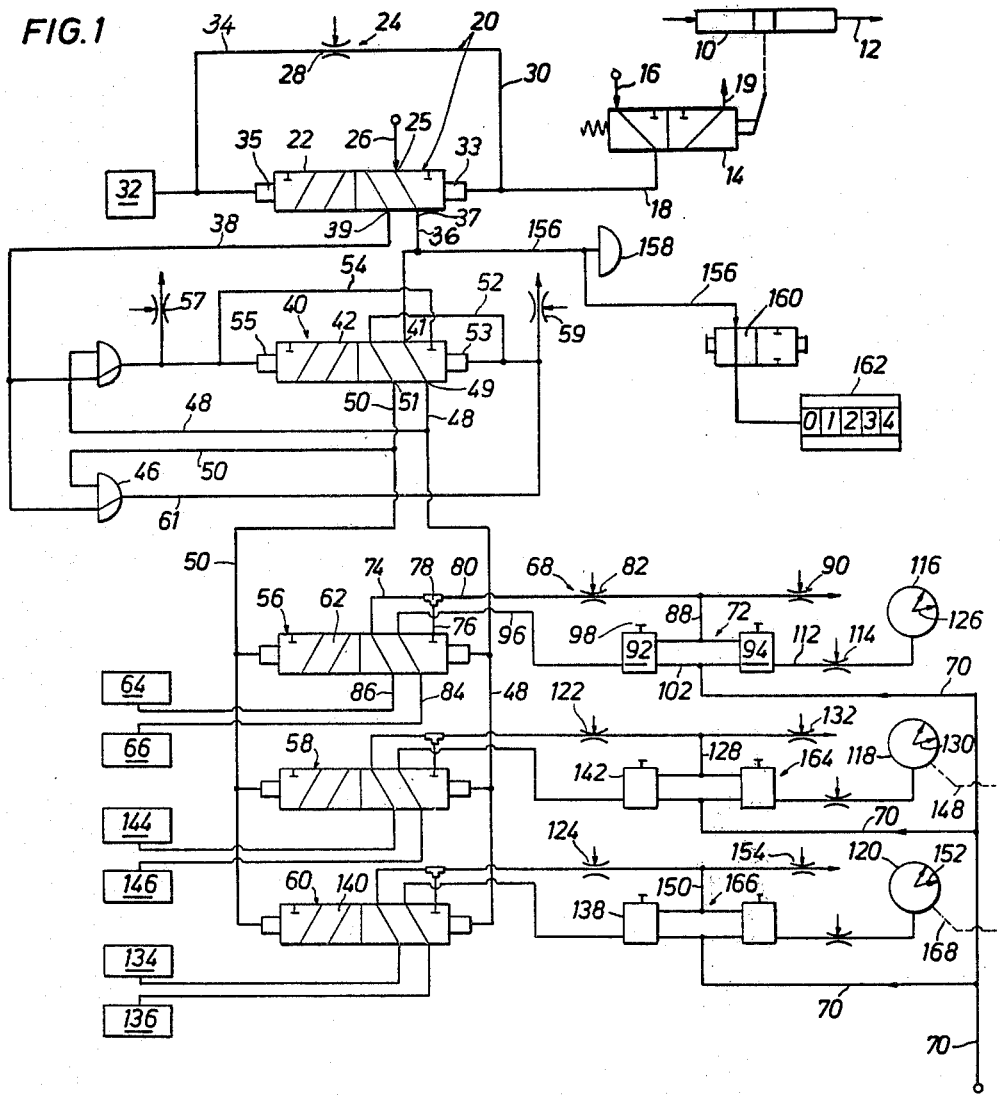
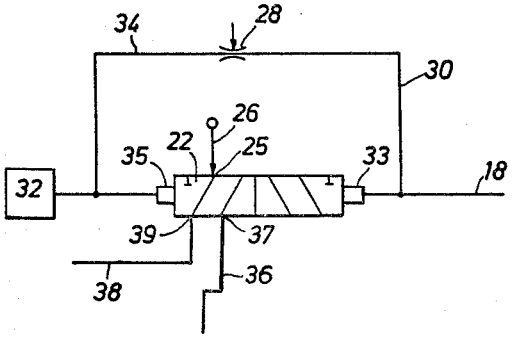
FIG. 2

APPARATUS FOR PNEUMATICALLY MONITORING CONDITIONS OF A WELL CIRCULATING SYSTEM

BACKGROUND OF THE INVENTION

1. Field of the Invention

Pneumatic apparatus for monitoring the conditions of a drilling fluid circulating system of a well.

2. Description of the Prior Art

It is customary in well drilling operations, as for example oil and gas wells, to utilize a drilling fluid to remove cuttings and to maintain proper bottom-hole pressures and temperatures. In a typical operation, the drilling fluid, commonly called drilling mud, is circulated from mud tanks located on the surface and adjacent the drilling rig down the drill pipe, out the rotary bit, and returned to the mud tanks through the annulus formed between the bore hole and the drill pipe. Since the drilling mud is continually being circulated from the bottom of the well, it is used as a source of information as to the nature of the various strata or formations which are pierced by the drill bit. The materials contained in the mud and the back pressure exerted by it tell the operator if certain formations may be productive of hydrocarbons, and the pressure contained in the formations. Thus, it is important to closely monitor pressure and flow rate of the circulating system as the well is being drilled.

Various problems often arise during drilling operations which may damage the well circulating system, the formations, surface property, or cause erroneous information to be obtained. One of these problems is known as a washout which occurs when a hole develops in the drill pipe. A portion of the drilling mud then passes through this hole and up the annulus rather than being circulated down to the bit. The mud passing through the hole often severs the drill pipe leading to an expensive fishing operation. The formation surrounding the hole is often damaged or washed away by the escaping mud. Since a portion of the mud is short-circuiting the system, a decrease in drill pipe pressure, the pressure required to circulate the mud through the well, will be an indication that a washout has occurred.

Another problem that occurs during drilling operations is lost circulation, a condition where mud flow into the well exceeds mud flow from the well. This may occur when an abnormally low-pressure zone is encountered and the drilling pressure, which had been needed for proper drilling through to upper zones, exceeds the pressure of the formation currently being drilled. In this situation, mud may be forced out into the low pressure formation with the upper high pressure formations flowing into the borehole. This situation can lead to lost control of the well resulting in a blowout. The formation may be severely damaged and possibly prevent any future hydrocarbon production from it. Also, significant amounts of expensive drilling mud may be lost.

As is apparent, it is important that an operator continually monitor the conditions of the circulating system in order to prevent these and other problems which exist during drilling operations.

Currently, several monitoring devices are utilized in the oil drilling industry. Many of these instruments are partially or totally electrically operated. Due to the hazardous environment in which drilling operations are conducted, electrically operated equipment can present severe problems and limitations. Also, the corrosive atmosphere of offshore operations limits the use of electrical systems.

There are currently pneumatic instruments which measure one variable or another in a circulating system, but no system currently available conveniently presents a representative picture of the circulating system in a manner which enables the operator to quickly diagnose the problem and remedy the situation.

SUMMARY OF THE INVENTION

An improved monitoring apparatus according to a preferred embodiment of the present invention includes a limit valve attached to the pump which circulates drilling fluid to a well. The valve is adapted for generating a pneumatic signal representative of the pump stroke rate.

A remote repeater valve is operably connected to the limit valve. This repeater valve receives this signal and generates, in response to them, a pair of substantially similar pneumatic signals. These pneumatic signals are communicated to a frequency divider which generates a second pair of pneumatic signals in response to the first but having equal duration times.

The pneumatic signals from the frequency divider are received by a plurality of metering valve assemblies which produce rate pressures representative of the pump stroke rate. These rate pressures are communicated to a plurality of relay assemblies and used to provide to the metering valve assemblies a pneumatic fluid having a pressure in excess of the rate pressure. A pressure gauge is attached to each of the relay assemblies and selectively indicates changes in the rate pressure.

BRIEF DESCRIPTION OF THE DRAWINGS

FIG. 1 is a schematic view of one preferred embodiment of the pneumatic circuit apparatus of this invention.

FIG. 2 is a similar view of a detailed subcircuit of the pneumatic circuit apparatus shown in FIG. 1.

DESCRIPTION OF THE PREFERRED EMBODIMENT

Figure 3:
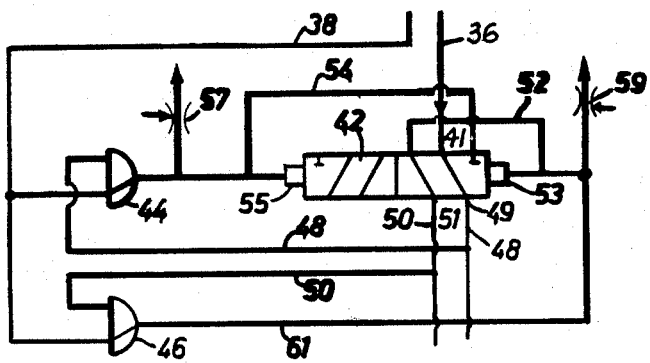
FIG. 3 is a schematic view of a frequency divider subcircuit which may be used with the apparatus shown in FIG. 1.

With reference to FIG. 1, there is shown one preferred embodiment of apparatus in accordance with this invention for monitoring conditions of a mud circulating system.

In this embodiment there is illustrated a pump 10 connected to mud flow line 12 leading to the well being drilled. The pump 10 is powered by any conventional means such as an internal combustion engine (not shown). Pump 10 circulates drilling mud from surface mud tanks into flow line 12, down drill pipe in the well, out the drill bit, up the annulus formed between the well bore and the drill pipe, and thence back to the mud tanks at the surface.

A limit valve 14 is attached to a portion of pump 10 such that limit valve 14 is shifted from its "on" position, as shown in FIG. 1, to its "off" position by the movement of pump 10. For example, valve 14 may be attached to the piston rod or a similar member of pump 10 which is reciprocated on each stroke of the pump. Thus, valve 14 is shifted first to the "off" position as the reciprocating member moves in one direction and then back to the "on" position during the return portion of the reciprocatory movement during one complete pump stroke. Limit valve 14 is connected to a first remote pneumatic fluid supply 16 such that when limit valve 14 is in the "on" position, pneumatic fluid under positive pressure (perhaps 50 to 60 p.s.i.) is passed through limit valve 14 into pulse line 18. In the "off" position of limit valve 14, fluid supply 16 is blocked off and pulse line 18 is connected to an exhaust port 19 of limit valve 14. This arrangement results in limit valve 14 being shifted "on" and "off" on each stroke of the pump 10 and thus line 18 is alternatively pressurized and then completely or partially vented (depending upon the stroke rate) by each stroke of pump 10. This shifting results in a pneumatic signal or a series of pressure pulses being generated by the movement of pump 10.

Oftentimes it is necessary, due to physical limitations or the necessity of repairing pump 10, to attach limit valve 14 to pump 10 in a manner such that limit valve 14 occupies either its "on" or its "off" position for a longer period of time than it occupies the other position. This results in generating a series of pulses with unequal duration times. For example, the limit valve 14 may be positioned such that for a pump stroke requiring 6 seconds to complete, limit valve 14 occupies its "on" position for 2 seconds and its "off" position for 4 seconds. Thus, limit valve 14 generates a pneumatic signal composed of pneumatic pulses having unequal time durations yet still representative of the movement of pump 10 as it circulates the drilling mud through the mud system.

This first series of pneumatic pulses is transmitted through line 18 to repeater valve assembly 20 located adjacent the drilling controls and remote from pump 10. Repeater valve assembly 20 receives the pneumatic signal generated by limit valve 14 and generates a first pair of pneumatic signals substantially similar to the first series of pneumatic pulses. Repeater valve assembly 20 is designed to operate at high speeds and facilitate transmission of pneumatic pulses over long distances.

Repeater valve assembly 20 is composed of repeater valve 22, pilot integrator 24 and second remote pneumatic fluid supply 26.

Repeater valve 22 is a pneumatically operated, four-way valve having one inlet 25, two outlets 37 and 39 connected respectively to flow lines 36 and 38, and opposite pilot ports 33 and 35. One pilot port 33 is connected directly to pulse line 18. Pulse line 18 is also connected in fluid communication through pilot integrator 24 to the opposite pilot port 35 of repeater valve 22.

Pilot integrator 24 is composed of flowline, 30, adjustable flow restrictor 28, flowline 34, and fluid cell 32. Restrictor 28 is connected to pulse line 18 through flowline 30, and to fluid cell 32 and pilot port 35 through flowline 34. Thus, the first series of pneumatic pulses are transmitted directly to one pilot port of repeater valve 22 through the pulse line 18 and simultaneously to flow restrictor 28 through flowline 30. The pneumatic pulses passing through restrictor 28 are smoothed and transmitted to fluid cell 32. After a constant pump stroke rate is maintained for a short period, a nearly steady state pressure is reached in line 34 and fluid cell 32, which pressure is substantially equal to the average of the maximum and minimum valves of the pneumatic pulses generated by limit valve 14 for that specific pump stroke rate. This average pressure is transmitted to and remains on the pilot port 35 of valve 22.

Thus, when the pressure in pulse line 18 is above the average pressure at port 35, repeater valve 22 shifts to its "first" position shown in FIG. 1. In this position, the outlet 37 is open and the outlet 39 is closed.

When the pressure in pulse line 18 is below the average pressure at port 35 due to the shift of valve 14 to its vented position, repeater valve 22 is shifted to its second position, in which position outlet 39 is open and outlet 37 is closed. Repeater valve 22 is thus shifted each time limit valve 14 is shifted, making its movement also representative of the movement of pump 10.

The inlet port 25 of repeater valve 22 is connected to a second remote pneumatic fluid supply 26 which provides a pneumatic fluid at a pressure of about 25 to 35 p.s.i. As seen in FIG. 1, when repeater 22 is in its "first" position supply 26 pressurizes flow line 36 through outlet 37, and flowline 38 is vented through an exhaust port. When in the "second" position, shown in FIG. 2, supply 26 pressurizes flowline 38 through outlet 39, and flowline 36 is vented. Thus, it can be seen that as repeater valve 22 is shifted between its first and second positions, flowlines 36 and 38 are alternatively pressurized by supply 26 and then vented.

This action of repeater valve 22 creates in lines 36 and 38 a pair of pneumatic signals substantially similar to that generated by limit valve 14, and therefore representative of the movement of pump 10.

Since repeater valve 22 shifts in response to the pneumatic signal generated by limit valve 14, the pair of substantially similar pneumatic signals generated by repeater valve 22 is also of unequal time duration. For example, repeater valve 22 may remain in its first position for four seconds and in its second position two seconds out of a complete six-second cycle, thereby creating pneumatic pulses in each signal which have unequal duration times.

The pair of pneumatic signals generated by repeater valve assembly 20 is transmitted through flowlines 36 and 38 to a frequency divider, shown generally at 40. Frequency divider 40 is adapted for receiving a pair of pneumatic signals composed of pulses having unequal duration times such as those generated by repeater valve assembly 20, and generating in response thereto a second pair of pneumatic signals composed of pulses having equal duration times, but having a frequency one-half that of the signal generated by valve assembly 20.

As is more clearly seen in FIG. 3, frequency divider 40 includes a divider valve 42 with logic elements 44 and 46 connected to its outlets and exhaust ports. Divider valve 42 is a pneumatically operated valve having one inlet 41, two exhaust ports, two outlets 49 and 51, and opposite pilot ports 53 and 55. Outlets 49 and 51 are connected to flowlines 48 and 50, respectively.

Flowline 36 is connected to the inlet 41 of valve 42 and flowline 38 connected to logic elements 44 and 46.

Figure 3A:
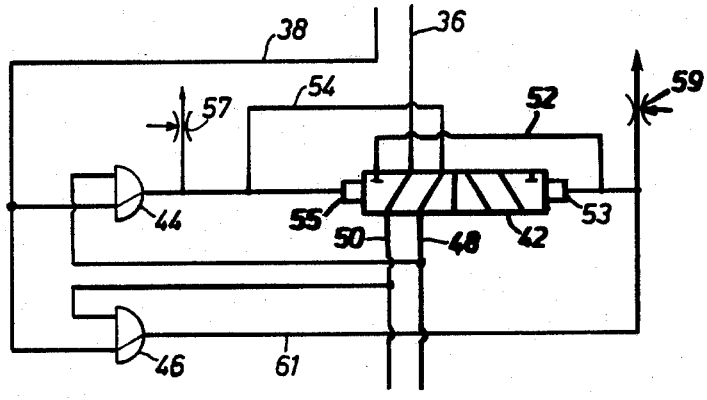
FIG. 3A is a schematic view of the frequency divider shown in FIG. 3, with the valve in a second position.

Valve 42 is arranged such that in its "first" position, as seen in FIG. 3, flowline 36 is connected through valve 42 in fluid communication with flowline 48, and flowline 50 is connected through flowline 52 to the first pilot port 53 of valve 42. In the second position of divider valve 42 as seen in FIG. 3a, flowline 36 is connected through valve 42 in fluid communication with line 50, and line 48 is connected to the other pilot port 55 through flowline 54.

Flowline 38 is connected directly to logic elements 44 and 46. Logic elements 44, 46 are constructed such that when they are pressurized by a signal input from lines 48 or 50, they produce an output flow or signal by allowing flow to pass through them, but if unpressurized by a signal input, they block such flow. As depicted in FIG. 3, logic element 44 is adapted for receiving a signal input from flowline 48 and communicating flowline 38 to pilot port 55 of divider valve 42. Thus, when flowline 48 is pressurized by a signal input, logic element 44 is in its flow or "yes" position and flowline 38 is communicated to pilot 55 of divider valve 42. When flowline 48 is unpressurized or vented as described below, logic element 44 shifts into its blocked or "no" position and line 38 does not communicate with pilot port 55 of divider valve 42. A typical logic element suitable for the above purposes is Miller Moving Parts logic element type NO. 81.501.065. Logic element 46 is connected between flowline 38 and pilot 53 of divider valve 42 and adapted for receiving a signal input coming from flowline 50. Thus, logic element 46 allows communication through it from flowline 38 to pilot port 53 when flowline 50 is pressurized.

The above described arrangement results in divider valve 42 being held in its two positions an equal amount of time and therefore producing pneumatic signals composed of pulses of equal time duration. This is accomplished by having divider valve 42 shift positions only once while repeater valve 22 shifts twice. Thus, in the case of a reciprocal pump, divider valve 42 shifts once for each complete stroke of pump 10.

Referring to FIG. 3, with flowline 36 pressurized by repeater valve 22 being in its first position and divider valve 42 in its first position, flowline 48 and logic element 44 are also pressurized. Although logic element 44 is in its "yes" position, no signal is sent to pilot 55 since line 38 is not pressurized. When repeater valve 22 shifts from its first to its second position, as in FIG. 2, in response to limit valve 14, flowline 38 is pressurized and line 36 is vented. Although flowline 36 and thus flowline 48 is connected to an exhaust port through repeater valve 22, there is sufficient residual pressure in flowline 48 to hold logic element 44 in its "yes" position momentarily. During this brief period, line 38 pressurizes pilot port 55, shifting divider valve 42 into its second position (See FIG. 3*a*) and pressurizes line 54 connected to an exhaust port of divider valve 42 since logic element 44 is in its "yes" position. Divider valve 42 is arranged such that in its second position line 48 is connected to line 54, thereby maintaining pressure in flowline 48 and holding logic element 44 in its "yes" position. Thus, line 48 is continually pressurized as long as line 38 is pressurized by valve 22. Although some pressure is lost, sufficient pressure is maintained by restrictor 57 to insure that valve 42 remains in a completely shifted position. The above described sequence results in allowing repeater valve 22 and divider valve 42 to shift from their first to their second positions while maintaining pressure in outlet flowline 48.

Repeater valve 22 is now shifted back to its first position by the signal from limit valve 14 thereby pressurizing line 36. Since divider valve 42 still remains in its second position (See FIG. 3*a*), flowline 36 pressurizes flowline 50 and logic element 46 while flowline 48 is partially vented through restrictor 57. Since flowline 38 is not pressurized although logic element 46 is in its "yes" position, divider valve 42 is not shifted to its first position by this shift of repeater valve 22.

When repeater valve 22 is shifted back to its second position and pressurizes flowline 38, the above described sequence occurs again but through the operation of logic element 46, lines 50, 52 and restrictor 59. Logic element 46 is momentarily held in its "yes" position by residual pressure in flowline 50 thereby allowing line 38 to pressurize line 61 and pilot 53 thus shifting valve 42 back to its first position while maintaining pressure in line 50 through line 52 and keeping logic element 46 in its "yes" position. Flowline 48 is not pressurized by the shifting of divider valve 42 into its first position since flowline 36 is not pressurized until repeater valve 22 is again shifted back into its first position.

The above described sequency of steps causes divider valve 42 to shift only one way for each two shifts of repeater valve 22 and limit valve 14 and therefore each full cycle of pump 10. Divider valve 42 generates a pneumatic signal in each of flowlines 48 and 50 composed of pressure pulses of equal time duration and responsive to the movement of pump 10 but at one-half the frequency of the pneumatic signals generated by repeater valve 22.

In order to minimize pressure fluctuations developed by the metering valve assembly 56 as will be described below, and increase the overall accuracy of the monitoring apparatus, frequency divider 40 is inserted between repeater valve assembly 20 and metering valve assembly 56 to produce symmetrical pulses with equal time durations. Pneumatic signals having unequal duration times tend to decrease accuracy of the system due to large pressure differences developing between lines 74 and 76 since one line is pressurized for a longer period than the other line in each cycle. These large pressure differences cause large fluctuations in line 80 as will be more fully appreciated after a detailed description of metering valve assemblies, 56, 58, 60.

It is possible to physically position limit valve 14 with respect to the piston rod of pump 10 such that equal time duration pulses are generated. Such positioning is not economically acceptable due to the high rate at which mud pumps are repaired or changed as to displacement. Also, since well drilling is a rugged operation, it is difficult to maintain limit valve 14 in the precise location as to generate equal time duration pulses.

The pneumatic pulses generated by frequency divider 40 are communicated by flowline 48 and 50 to a plurality of metering valve assemblies 56, 58 and 60. Referring back to FIG. 1, each metering valve assembly, as for example 56, is connected directly to flowlines 48 and 50 and adapted for receiving pneumatic signals from frequency divider 40 and, in response to such signals, generating rate pressures representative of the movement of pump 10. A circuit similar to each of metering valve assemblies 56, 58 and 60 is disclosed in applicant's previously issued U.S. Pat. No. 3,750,480.

These previously patented circuits are adapted specifically for producing a linear output from pneumatic signals having equal duration times and periods of approximately 5 to 10 cycles per minute. The system presently disclosed by applicant is designed to operate in the range of 10–200 cycles per minute.

Figure 4:
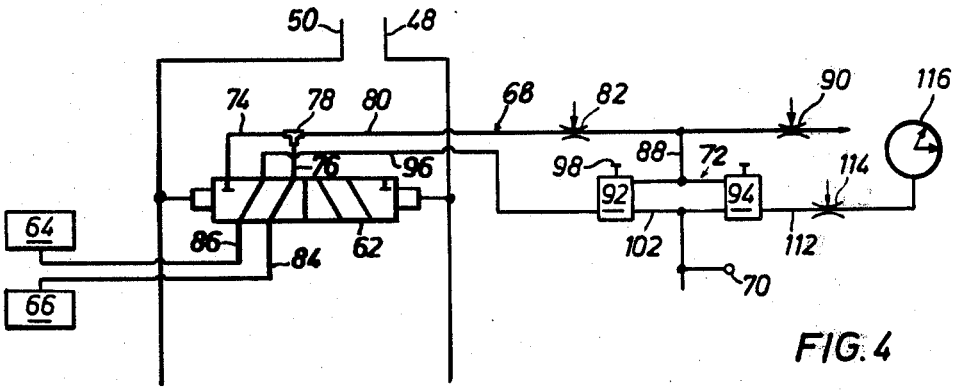
FIG. 4 is a schematic view of a metering valve assembly subcircuit in accordance with the present invention shown in the second position, with a relay assembly connected to a portion of the metering valve assembly.

First metering valve assembly 56 is composed of first metering valve 62, fluid cells 64, 66 and integrator 68. Referring to FIG. 4, metering valve 62 is a pneumatically operated valve having one inlet, two outlets and two exhausts. Flowlines 48 and 50 are connected to the pilot ports of metering valve 62 and causes valve 62 to shift between a first and a second position in response to signals from frequency divider 40. First and second fluid cells 64 and 66 are also connected to metering valve 62 such that when metering valve 62 is in its first position as shown in FIG. 1, first fluid cell 64 is communicated by one outlet to flowline 74 and second fluid cell 66 is communicated by the inlet of metering valve 62 to line 96. In the second position of valve 62 as shown in FIG. 4, these conditions are reversed with first fluid cell 64 connected to line 96 and second fluid cell 66 connected to line 76.

The inlet of metering valve 62 is at all times in fluid communication with a third remote pneumatic fluid supply 70 through first relay assembly shown generally at 72 in FIG. 4 whose operation will be described below.

Integrator 68, composed of a "Y"-shaped line connector 78 attached to lines 74, 76, to form single flowline 80, and a flow restrictor 82, is connected to lines 74 and 76 and receives pneumatic pulses directly from fluid cells 64, 66. The other end of flowline 80 is connected to adjustable flow restrictor 82 which is connected directly to first relay assembly 72.

The metering valve assembly and integrator arranged as described above operate to produce a substantially constant rate pressure for an established constant pump stroke rate as now described. Pneumatic signals generated by frequency divider 40 is transmitted through flowlines 48 and 50 to the pilot ports of metering valve 62. Valve 62 shifts between its first and second positions in response to these pneumatic signals and thus its movement is representative of the movement of pump 10. When valve 62 is in its first position, supply 70 pressurizes fluid cell 66 through lines 84 and 96 while fluid cell 64 is being discharged through lines 86 and 74. When valve 62 is shifted into its second position as shown in FIG. 4, previously pressurized fluid cell 66 is allowed to discharge through lines 84 and 76 while fluid cell 64 is pressurized by supply 70 through lines 86 and 96. This sequential pressurization and discharging of each of fluid cells 64 and 66 into lines 74 and 76 creates a pneumatic signal or series of closely spaced pneumatic pulses in line 80 and adjustable flow restrictor 82. Adjustable flow restrictor 82 has the effect of smoothing these pneumatic pulses into a pressure signal representative of the rate the pulses are received from fluid cells 64 and 66. This pressure signal or rate pressure is a direct indication of the movement of pump 10, such as the number of strokes per unit of time. This rate pressure is communicated through adjustable flow restrictor 82 and into line 88 to relay assembly 72 and used as a signal as described below.

Referring again to FIG. 4, rate pressure from line 88 is divided into three portions, one portion being communicated directly to venting restrictor 90, a second portion going to first bias relay 92 and the third portion communicated to second biased relay 94. Venting restrictor 90 is an adjustable flow restrictor arranged such that the rate pressure in line 88 is controllably discharged to the atmosphere at such a rate as to prevent over pressurization of line 88 for a given range of expected pump rates. Restrictor 90 is also used to adjust and calibrate the output of a portion of the system as will be described below.

Figure 5:
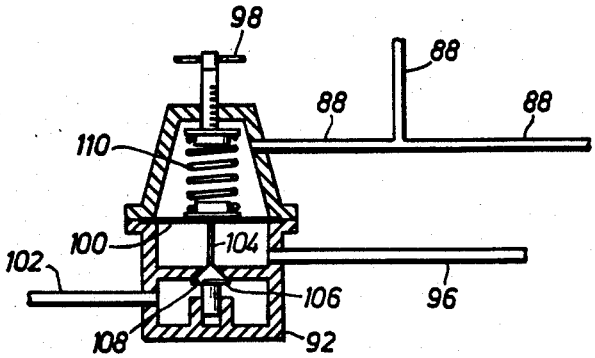
FIG. 5 is a schematic view of a somewhat simplified embodiment of the bias relay portion of the pneumatic circuit apparatus shown in FIG. 1.

First biased relay 92 operates between supply 70 and the input port of metering valve 62 to provide a pneumatic fluid to line 96 which has a greater pressure than the rate pressure in line 88. This difference in pressure is determined by adjusting bias control 98. The ability of bias relay 92 to provide such a pressure is better understood with reference to FIG. 5, a detailed cross-sectional view of relay 92. In FIG. 5, pressurized pneumatic fluid from supply 70 is provided through flowline 102 to the lower portion of bias relay 92. Relay 92 has an output pressure on line 96 which is equal to the sum of the manually controlled pressure set by bias control 98 plus the rate pressure delivered to relay 92 by line 88. Basically the construction and operation of relay 92 is as follows. Relay 92 is divided into upper and lower chambers by diaphragm 100, from which depends valve stem 104 having a valving member 106 thereon. Valving member 106 operates in valve seat 108 to control the flow of pressurized fluid from line 102 to line 96. Diaphragm 100 is urged downward by bias spring 110, thereabove, the downward force of which is adjustable by turning bias control 98. In addition, diaphragm 100 is urged downward by rate pressure thereabove which is received from line 88. Therefore, the resulting output pressure on line 96 is always greater in pressure than the pressure in line 88 by a preset amount determined by the downward bias exerted by spring 110. A fuller description of the operation of such a relay is obtained in applicant's previously issued U.S. Pat. No. 3,750,840.

Second bias relay 94 is connected to flowlines 88 and 102 in the same manner as first bias relay 92 except that the output of bias relay 94 is communicated and smoothed by line 112 and gauge resistor 114 to pressure gauge 116. Utilization of relay 96 in place of locating gauge 116 directly in line 88 is advantageous due to the pressure ranges of most standard instrument gauges. Thus, output pressure from second bias relay 96 is regulated by rate pressure of line 88 such that output pressure in line 112 is an accurate indicator of any changes in rate pressure and thus pump rate changes.

Referring back again to FIG. 1, a plurality of metering valve assemblies 56, 58 and 60 along with their accompanying relay assemblies 72, 164 and 166 and circuitry are connected such that they are operated in conjunction with each other in response to the pneumatic signals generated by frequency divider 40. Such an arrangement produces three rate pressures which are all representative of the movement of pump 10 and may be displayed on three independently calibrated pressure gauges 116, 118, 120. In order to present a system for monitoring a circulating system, three variables will be observed; pump stroke rate, mud flow rate, and stand pipe pressure. Rate pressure provided by each of the metering valve assemblies is used as an indicator of each of these three variables. Since these rate pressures are relative to pump rate it is necessary that each of the rate pressures vary with a change in pump rate in the same manner as one of three variables change with the same change in pump rate. Thus, since pump stroke rate varies linearly with any change in pump movement, one pressure rate must vary linearly with any change in pump movement. Also, since mud flow rate becomes non-linear at high pump rates, one rate pressure must become non-linear at high pump rates. Standpipe pressure varies exponentially with changes in pump rate so it is necessary that the third rate pressure vary exponentially with changes in pump rate. It has been observed that a rate pressure from a pneumatic circuit such as depicted in FIG. 4 can be adjusted to more closely represent empirical measurements by altering the volumes of the two fluid cells attached to the metering valve, the amount of restriction presented by adjustable flow restrictors 82, 122, 124 and increasing input pressure to metering valve assemblies 56, 58 and 60 from their respective relay assemblies.

Referring to FIG. 4, adjustable flow restrictor 82 can be altered to adjust the linearity of a rate pressure increase as the pump rate is increased. When the inlet pressure in line 96 differs only a small amount from the rate pressure in line 88 and fluid cells 64 and 66 have small volumes, the rate pressure produced in flowline 88 increases nearly linearly with a linear increase in pump rate and little restriction is needed in adjustable flow restrictor 82. Fluid cells 64 and 66, adjustable flow restrictor 82, and the pressure of flowline 96 are adjusted in this manner to provide a linear rate pressure increase as pump rate is increased. Such a response is required for the system to accurately indicate pump stroke rate. Pressure gauge 116 is connected to first relay assembly 72 and thus displays this linear response to a linear increase in pump rate. Gauge 116 is calibrated in pump strokes per minute with scale adjustments being made in the field by adjusting both venting restrictor 90 and bias control 98.

A manually set pointer 126 is mounted on gauge 116 which can be indexed to an established pump rate indicated by the first pointer. Pointer 126 serves as a memory pointer to indicate when the pump rate has changed. Thus, in normal field operations a constant pump stroke rate is obtained and verified by other means. If necessary, gauge 116 can be recalibrated by adjusting restrictor 90 and bias control 98 to display the appropriate strokes per minute reading with pointer 126 positioned to coincide with this reading. Such a setting allows the operator of the drilling rig to observe any changes in pump stroke rate that may occur.

Second metering valve assembly 58 is actuated in a manner similar to first metering valve assembly 56 and produces a pressure rate representative of pump stroke rate. Pressure gauge 118 is arranged similar to gauge 116 to receive a signal pressure from second metering valve assembly 58 but with flow restrictor 122 adjusted such that the rate pressure of line 128 increases slightly non-linearly for high pump rates, as for example 75 strokes per minute by a duplex pump, in order that the rate pressure more nearly match the reduced pump efficiency at these higher stroke rates.

Pressure gauge 118 is calibrated in gallons per minute of mud pumped into the flowline and the well. Since the amount of fluid pumped is directly proportional to the number of strokes per minute of pump 10 (except for lost efficiency at higher pump rates) a rate pressure representative of the movement of pump 10 is also representative of the gallons per minute being supplied to the circulating system by pump 10.

Pressure gauge 118 is a duplex or double gauge with two pointers and two inlet ports. The second inlet and pointer are connected by line 148 to an independent metering device (not shown) which produces a pneumatic pressure representative of the actual mud flow rate being returned from the well and discharged into mud tanks, or any other final discharge point of the circulating system. One suitable metering device which produces satisfactory results is Warren Automatic Tool Company of Houston, Texas, FLO-SHO Model Indicator and Recorder. During normal operations with constant pump and mud return rates (verified by constant mud tank levels) second pointer 130 of gauge 118 connected to the independent metering device provides a constant gallons per minute reading. Venting restrictor 132 is then adjusted such that the pointer of gauge 118 which is responsive to second metering valve assembly 58 coincides with second pointer 130. In this manner, pump 10 is utilized as a positive displacement flow meter with the rate pressure of second meter valve assembly 58 being responsive to any changes in the rate at which mud is supplied to the well by pump 10. Thus, pressure gauge 118 can be used to monitor any sudden changes in mud flow rates in and out of the well. For example, if pressure gauge 116 remains constant indicating that there has been no slowing down of pump 10, but pointer 130 of gauge 118 indicating rate of mud return drops below the other pointer connected to second metering valve assembly 58, the operator would be warned that input mud rate exceeds return mud rate and lost circulation is occurring. This condition is required to be remedied quickly in order to avoid damage to the formation and loss of expensive drilling mud.

The third metering valve assembly 60 functions similarly to the above described metering valve assemblies by providing to pressure gauge 120 a signal pressure responsive to the pump rate. Gauge 120 indicates standpipe pressure, the pressure at the top of the well required to force mud through the well at a given flow rate. As is known, standpipe pressure is exponentially related to pump stroke rate. Thus, in order to produce a signal pressure which is accurately representative of standpipe pressure, it is necessary to adjust the response characteristics of the rate pressure with respect to changes in pump rate. In order to produce an exponential response, certain elements of third meter valve assembly are altered. Bias relay 138 is adjusted to provide to third meter valve 140 pneumatic fluid at a higher pressure than is provided by biased relays 92 or 142. Also, the volumes of fluid cells 134, 136 are increased to four or five times that of fluid cells 64, 66, 144, 146. With adjustable flow restrictor 124 essentially fully opened and the flow produced by fluid cells 134, 136 through restrictor 124 greatly increased, the rate pressure in line 150 tends to increase more rapidly at the high pump rates and thus is analogous to standpipe pressure.

Pressure gauge 120 is also a duplex or double gauge with dual pointers and inlets. Gauge 120 receives a second signal through line 168 from a pressure transmitter located in the mud flowline between pump 10 and the well (not shown) which measures the actual pump output flow pressure or standpipe pressure. This pressure is displayed by second pointer 152 on gauge 120, gauge 120 being calibrated in pounds per square inch. Under normal operating conditions with constant pump rate, pointer 152 indicates actual standpipe pressure. Venting restrictor 154 is then adjusted such that the first pointer of gauge 120, connected to third metering valve assembly 60, coincides with second pointer 152. While increasing the pump rate, restrictor 124 is used to match the rate pressure indicated by the first pointer of gauge 120 with pointer 152 which indicates the actual standpipe pressure as it increases non-linearly. Thus, pressure gauge 120 indicates actual standpipe pressure and a predicted standpipe pressure relative to pump rate. If, during drilling operations, the actual standpipe pressure decreases while predicted standpipe pressure remains constant, the drill attendant is alerted to the possibility that the drill pipe may have split allowing some of the mud to bypass the drill bit and return to the surface. This "short circuiting" or washout will also part the drill string or damage the well formation unless quickly discovered and remedied.

The above described apparatus provides complete monitoring of the circulating system for the drilling operator. A single variable, pump stroke rate, is measured, displayed to the operator and converted into units of two other variables which present a complete picture of the mud circulation. Examples of conditions that may be detected by the described apparatus follow. If the operator observes that gauge 116 indicates a decrease in pump rate as compared to the previous rate indicated by memory pointer 126, and both pointers on each of gauges 118 and 120 remain together but at some lower value, the operator will know that the pump has simply slowed down without a changed condition in the circulating system.

Another possible situation that may arise is that gauge 116, pump rate, and gauge 118, flow rate, remain constant but pointer 152, actual standpipe pressure, of gauge 120 has dropped 200 to 300 p.s.i. below the first pointer, predicted standpipe pressure. This would be an indication of a washout as previously discussed. This combination of gauge readings would indicate that pump 10 has not decreased its rate or input into the well, and the output flow rate is the same as input flow rate. Thus, the only explanation for the reduced standpipe pressure is that some mud is bypassing the drill bit nozzles.

Still another probable situation that may occur is a partial failure of pump 10 causing a reduced output for a constant pump speed. This is shown by gauge 116 remaining constant but pointers 130, outflow rate, and pointers 152, actual pressure being less than normal.

Yet still another possible situation is a gain or loss in the mud flow out of the well which will be shown by a comparison of the pointers of gauge 118. This is verified as a real gain or loss by observing that the pointers of gauges 116 and 120 remain coincident.

As discussed, it is necessary to utilize a plurality of separate and independent metering valve assemblies in order to produce several rate pressures having differing degrees of non-linearity in order to more accurately represent the variables to be monitored. Multiple metering valve assemblies also make it possible to replace some of the physical equipment without recalibrating the entire monitoring system. For example, it is common practice for a drilling rig to have an auxiliary mud pump for use when repairs are required. This second pump may be of a different displacement and, thus for a given stroke rate, it would produce a flow rate different from the flow rate produced by the first pump. Gauge 116, pump rate, would function properly for either pump but gauge 118, flow rate, would be required to be recalibrated when pumps are changed. Independent metering valve assemblies allow gauge 116 to remain unchanged.

Also illustrated in FIG. 1 is a modification to the above apparatus. In order to facilitate the calibration of the apparatus it may be desirable to attach a pneumatic counter subcircuit for counting and recording the actual number of pump strokes. The pneumatic pulse generated by repeater valve 20 may also be communicated by flowline 156 to a pneumatically operated switch 158 which simulates a panel light. Such a switch is the "Rotowink" model made by Norgren Fluidics Company. Switch 158 flashes on and off similar to a blinking light and in response to the pneumatic pulse produced by each pump stroke to give an easily observable indication that the pump is operating. Flowline 156 is also connected to counter valve 160 which allows an air actuated digital counter 162 to be started and stopped in response to the pneumatic pulses. Thus, with digital counter 162 in operation, the operator can record the number of pump strokes which occur over a period of time measured by a hand-operated stop watch and thus calibrate gauge 116 by adjusting the proper restrictors.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. Apparatus for monitoring conditions in a fluid circulating system having a pump and a piping system connected to a final discharge point, comprising:

means for generating a first signal representative of the rate of movement of said pump;

a first display means connected to said first signal for reading out said first signal;

means for generating a second signal representative of the pump output flow pressure;

means for converting a portion of said first signal into an adjustable analog signal of pump output fluid pressure;

a second display means connected to receive said second signal and said adjustable analog signal of pump output fluid pressure for reading out variations therebetween as indications of volumetric efficiency of said pump and conditions of said piping system;

means for generating a third signal representative of the fluid flow rate at said final discharge point;

means for converting a portion of said first signal into an adjustable analog signal of the fluid flow rate at said final discharge point; and a third display means connected to receive said third signal and said adjustable analog signal of the fluid flow rate at said final discharge point for reading out variations therebetween as indications of fluid rate into and out of said piping system and conditions of said piping system, thus enabling an operator to monitor conditions in said circulating system by observing one or more of said display means.

2. Apparatus for use during drilling operations to monitor conditions of a well circulating system having a pump and a piping system for circulating the drilling fluid through said well into discharge tanks, comprising:

means for generating a first pneumatic signal representative of the rate of movement of said pump;

a first display means connected to said first signal for reading out said first signal;

means for generating a second pneumatic signal representative of the pump output flow pressure;

means for converting a portion of said first signal into an adjustable analog pneumatic signal of pump output fluid pressure;

a second display means connected to said second signal and said adjustable analog pneumatic signal of pump ouput fluid pressure for reading out variations therebetween as indications of volumetric efficiency of said pump and conditions of said piping system;

means for generating a third pneumatic signal representative of the fluid flow rate into said discharge tanks;

means for converting a portion of said first pneumatic signal into an adjustable analog pneumatic signal of the fluid flow rate into said discharge tanks; and a third display means connected to receive said third pneumatic signal and said adjustable analog pnuematic signal of the fluid flow rate into said discharge tanks for reading out variations therebetween as indications of fluid rate into and out of said well and conditions of said piping system, thus enabling a drilling operator to monitor conditions in said circulating system by observing one or mores of said display means.

3. Pneumatic frequency divider apparatus for receivng first and second on-off pneumatic signals having simultaneous periods composed of unequal on and off times, said first pneumatic signal having an on time equal to and concurrent with the off time of the second pneumatic signal, and an off time equal to and concurrent with the on time of the second pneumatic signal, and for producing third and fourth on-off pneumatic signals each having a period twice that of said first and second pneumatic signals and composed of equal on and off times, said third signal having an on time concurrent with the off time of the fourth signal and an off time concurrent with the on time of the fourth signal, comprising:

a divider valve having one inlet adapted for receiving the first pneumatic signal and two outlets adapted for transmitting the third and fourth pneumatic signals, said divider valve arranged to shift between a first position and a second position in response to second pneumatic signal; and a pair of logic elements connected to said divider valve and adapted for selectively communicating said second pneumatic signal to said divider valve.

4. Frequency divider apparatus in accordance with claim 3, wherein said logic elements are arranged to shift said divider valve between its first and second positions once during each period of said second pnuematic signal.

5. Frequency divider apparatus in accordance with claim 3, wherein output flow from each of said logic elements provides a signal input to itself through said divider valve to maintain said logic element in its flow position until output flow terminates, said divider valve being maintained in a fully shifted position by said output flow.

6. Pneumatic apparatus for producing pneumatic signals having equal on and off times which are representative of a first on-off pneumatic signal having equal periods composed of unequal on and off times, comprising:

a repeater valve assembly adapted for receiving said first pneumatic signal and generating in response thereto a pair of substantially similar pneumatic signals; and a frequency divider connected to said repeater assembly, for converting said pair of substantially similar pneumatic signals into a second pair of pneumatic signals, said second pair of pneumatic signals haivng equal on and off times.

7. Pneumatic apparatus for producing pneumatic signals which are representative of a movement per unit time and which have equal on and off times, comprising:

a limit valve connected to a first pneumatic fluid supply, said limit valve adapted for producing a first pneumatic signal representative of said movement;

a repeater valve assembly connected to said limit valve, said repeater assembly adapted for receiving said first pneumatic signal and generating in response thereto a pair of substantially similar pneumatic signals; and a frequency divider connected to said repeater assembly, said frequency divider adapted for converting said pair of substantially similar pneumatic signals into a second pair of pneumatic signals, said second pair of pneumatic signals having equal on and off times.

8. Pneumatic apparatus in accordance with claim 7, wherein said repeater valve assembly comprises a repeater valve having an inlet and two outlets, said inlet connected to a second pneumatic fluid supply, said repeater valve adapted for shifting between a first position and a second position in response to said first pneumatic signal, said second supply communicated to one of said outlets in the first valve position and to the other outlet in the second valve position, whereby a pair of pneumatic signals each having a frequency substantially similar to the first pneumatic signal is transmitted through said outlets.

9. Pneumatic apparatus in accordance with claim 8, wherein said repeater valve assembly further comprises: a pilot integrator interposed between said limit valve and a portion of said repeater valve, said pilot integrator arranged to convert a portion of the first pneumatic signal into a pneumatic fluid having a pressure substantially equal to the average pressure of said first pneumatic signal, said pilot integrator including:

a. a flow restrictor connected to said limit valve, for smoothing a portion of the first pneumatic signal; and b. a fluid cell interposed between said flow restrictor and said repeater valve, first fluid cell adapted for receiving the smoothed portion of the first pneumatic signal and transmitting to said repeater valve said pneumatic fluid having a pressure equal to the average pressure of said first pneumatic signal.

10. Pneumatic apparatus in accordance with claim 7, wherein said frequency divider comprises:

a divider valve having an inlet and two outlets, said divider valve arranged to shift between a first position and a second position, said inlet of said divider valve connected to said repeater valve assembly and adapted for receiving one of said pneumatic signals from said repeater valve assembly; and a plurality of logic elements interposed between said repeater valve assembly and said divider valve, said logic elements arranged to shift said divider valve between said first position and said second position only as said repeater valve assembly shifts from a first position to a second position.

11. Apparatus in accordance with claim 10, wherein output flow from each of said logic elements provides a signal input to itself through said divider valve, whereby said logic element is maintained in its flow position until output flow terminates, said divider valve being maintained in a fully shifted position by said output flow.

12. Pneumatic apparatus in accordance with claim 7, comprising:

a switch interposed between said repeater valve assembly and said frequency divider, said switch adapted for receiving a portion of one of the substantially similar pneumatic signals generated by said repeater valve assembly and producing an optical response representative of the rate of movement;

a counter valve interposed between said repeater valve assembly and said frequency divider, for receiving a portion of one of the substantially similar pneumatic signals generated by said repeater valve assembly and producing an on-off pneumatic signal for each increment of movement being represented; and a digital counter connected to said counter valve, for recording the number of on-off penumatic signals produced by said counter valve.

13. Pneumatic apparatus for monitoring changes in first and second on-off pneumatic signals having simultaneous periods composed of unequal on and off times, said first pneumatic signal having an on time equal to and concurrent with the off time of said second pneumatic signal, and an off time equal to and concurrent with the on time of said second pneumatic signal, comprising:

a frequency divider adapted for receiving said first and second pneumatic signals and converting said signals into a second pair of pneumatic signals having equal on and off times;

a plurality of metering valve assemblies connected to said frequency divider, each of said metering assemblies adapted for receiving said second pair of pneumatic signals and producing in response thereto a rate pressure representative of said first and second pneumatic signals;

a plurality of relay assemblies connected to said metering assemblies, said relay assemblies adapted for supplying a pneumatic fluid having a pressure in excess of said rate pressure; and a plurality of pressure gauges attached to said relay assemblies, each of said gauges selectively responsive to changes in said rate pressures.

14. Pneumatic apparatus in accordance with claim 13, wherein said frequency divider comprises a divider valve having one inlet adapted for receiving said first pneumatic signal and two outlets, said valve arranged to shift between a first position and a second position in response to said second pneumatic signal.

15. Pneumatic apparatus in accordance with claim 14, wherein said divider further comprises logic elements which are arranged to shift said divider valve between its first and second positions once during each period of said second pneumatic signal.

16. Pneumatic apparatus in accordance with claim 15, wherein output flow from each of said logic elements provides a signal input to itself through said divider valve, whereby said logic element is maintained in its flow position until output flow terminates, said divider valve being maintained in a fully shifted position by said output flow.

17. Pneumatic apparatus in accordance with claim 13, wherein each of said metering valve assemblies includes:

a metering valve having an inlet and two outlets, said inlet connected to one of said relay assemblies, said metering valve adapted for generating a pneumatic signal in response to said second pair of pneumatic signals, said metering valve also adapted for shifting between a first position and a second position;

a first and second fluid cell connected to said metering valve, said first fluid cell being communicated to said inlet and said second fluid cell being communicated to one of said outlets during first metering valve position, said first fluid cell being communicated to the other outlet and second fluid cell being communicated to said inlet during the second metering valve position; and an integrator attached to said metering valve outlets, said integrator smoothing the pneumatic signal from said metering valve and producing a rate pressure representative of said first and second on-off pneumatic signals being monitored, said integrator comprising:

a. a line connector having two inlets and a single outlet, said inlet attached to said metering valve outlets; and b. a flow restrictor attached to said single outlet of said line connector, said restrictor adapted for adjusting response characteristic of said rate pressure.

18. Pneumatic apparatus in accordance with claim 13, wherein each of said relay assemblies includes:

a venting restrictor connected to said metering valve assembly, said venting restrictor arranged to controllably discharge and adjust said rate pressure; a first bias relay interposed between said metering valve assembly and a remote pneumatic fluid supply, for supplying to said metering valve assembly a pneumatic fluid having a pressure in excess of said rate pressure;

a second bias relay connected to said metering valve assembly and interposed between said pressure gauge and said remote supply, said second bias relay adapted for supplying to said pressure gauge a pneumatic fluid having a pressure in excess of said rate pressure; and a gauge restrictor interposed between said second bias relay and said pressure gauge, said gauge restrictor adapted for smoothing said pneumatic fluid supplied by said second bias relay to said pressure gauges.

19. Pneumatic apparatus for use during drilling operations to monitor conditions of a well circulating system having a pump and a piping system for circulating drilling fluid through said well, comprising:

a limit valve operably connected to said pump and to a first pneumatic fluid supply, for producing a series of pneumatic pulses representative of the movement of said pump;

a repeater valve assembly connected in fluid communication with said limit valve, for receiving said series of pneumatic pulses and generating in response thereto a pair of substantially similar pneumatic signals;

a frequency divider connected in fluid communication with said repeater valve, for converting said pair of substantially similar pneumatic signals transmitted from said repeater valve into a second pair of pneumatic signals, said second pair of pneumatic signals having equal duration times;

a plurality of metering valve assemblies connected to said frequency divider, each for receiving said second pair of pneumatic signals and producing in response thereto a rate pressure responsive to changes in the movement of said pump;

a plurality of relay assemblies connected to said metering assemblies, for supplying a pneumatic fluid having a pressure in excess of said rate pressure; and pressure gauges attached to said relay assemblies, each of said pressure gauges selectively responsive to changes in said rate pressure, and indicating conditions in said well circulating system, thus enabling a drilling operator to monitor conditions in said circulating system in the absence of hazardous electrical connections, by observing one or more of said gauges.

20. Pneumatic apparatus in accordance with claim 19, wherein said repeater valve assembly comprises a repeater valve having an inlet and two outlets, said inlet connected to a second remote pneumatic fluid supply, fluid from said supply being communicated to one of said outlets in a first valve position and to the other of said outlets in a second valve position, whereby a pair of pneumatic signals substantially similar to the first series of pneumatic pulses is transmitted to said frequency divider.

21. Pneumatic apparatus in accordance with claim 20, wherein said repeater valve assembly further comprises a pilot integrator interposed between said limit valve and a portion of said repeater valve, said pilot integrator arranged to convert a portion of said first series of pneumatic pulses into a pneumatic fluid having a pressure substantially equal to the average pressure of said first series of pneumatic pulses, said pilot integrator including:

a flow restrictor connected to said limit valve, said restrictor smoothing a portion of said first series of pneumatic pulses; and a fluid cell interposed between said flow restrictor and said repeater valve, said fluid cell adapted for receiving the smoothed portion of said first series of pneumatic pulses and transmitting to said repeater valve, said pneumatic fluid having a pressure equal to the average pressure of said first series of pneumatic pulses.

22. Pneumatic apparatus in accordance with claim 19, wherein said frequency divider comprises a divider valve connected to said repeater valve assembly, for receiving one of said pneumatic signals from said repeater valve assembly, and a plurality of logic elements interposed between said repeater valve assembly and said divider valve, said logic elements arranged to shift said divider valve between a first position and a second position only as said repeater valve assembly shifts from a first position to a second position.

23. Pneumatic apparatus in accordance with claim 22, wherein output flow from each of said logic elements provides a signal input to itself through said divider valve, whereby said logic element is maintained in its flow position until output flow terminates, said divider valve being maintained in a fully shifted position by said output flow.

24. Pneumatic apparatus as recited in claim 19, wherein each of said metering valve assemblies includes:

a metering valve having an inlet connected to said relay assembly and two outlets, said metering valve generating a pneumatic signal in response to said second pair of pneumatic signals, said metering valve also adapted for shifting between a first position and a second position;

a first and second fluid cell connected to said metering valve, said first fluid cell being communicated to said inlet and second fluid cell being communicated to one of said outlets during first metering valve position and first fluid cell being communicated to the other outlet and second fluid cell being communicated to said inlet during second metering valve position; and an integrator attached to said metering valve outlets, said integrator smoothing the pneumatic signal from said metering valve and producing a rate pressure representative of the movement of said pump, said integrator comprising:

a line connector having two inlets and one outlet, said inlets attached to said metering valve outlets, and a flow restrictor attached to said single outlet of said line connector, for adjusting the response characteristics of said rate pressure.

25. Pneumatic apparatus in accordance with claim 19, wherein each of said relay assemblies includes:

a venting restrictor connected to said metering valve assembly, said venting restrictor arranged to controllably discharge said rate pressure;

a first bias relay interposed between said metering valve assembly and a third remote pneumatic fluid supply, for supplying to said metering valve assembly a pneumatic fluid having a pressure in excess of said rate pressure;

a second bias relay connected to said metering valve assembly and interposed between one of said pressure gauges and said third remote pneumatic fluid supply, for supplying to said pressure gauge a pneumatic fluid having a pressure in excess of said rate pressure; and a gauge restrictor interposed between said second bias relay and said pressure gauge, said gauge restrictor smoothing said pneumatic fluid supplied by said second bias relay to said pressure gauges.

26. In a pneumatic apparatus for use during drilling operations to monitor conditions of a well circulating system having a pump and a piping system for circulating drilling fluid through said well, the combination comprising:

a limit valve connected to said pump and to a first pneumatic fluid supply, for shifting between a first position and a second position in response to the movement of said pump and producing a first on-off pneumatic signal representative of the rate of movement of said pump;

a repeater valve having one inlet and two outlets, said inlet connected to a second pneumatic fluid supply, said repeater valve adapted for shifting in response to said first on-off pneumatic signal between a first position and a second position, said second supply communicated to one of said outlets during the first valve position and to the other outlet during the second valve position, whereby a pair of on-off pneumatic signals substantially similar to the first pneumatic signal is transmitted through said outlets;

a pilot integrator interposed between said limit valve and said repeater valve, said pilot integrator arranged to provide a pneumatic fluid having a pressure substantially equal to the average pressure of said first pneumatic signal, said pilot integrator includes (a) a flow restrictor connected to said limit valve, for smoothing a portion of the first on-off pneumatic signal; (b) a fluid cell interposed between said flow restrictor and said repeater valve, for receiving the smoothed portion of said on-off pneumatic signal and transmitting to said repeater valve a pneumatic fluid having a pressure equal to the average pressure of said first on-off pneumatic signal;

a divider valve having an inlet and two outlets, said divider valve arranged to shift between a first position and a second position, said divider valve connected to said repeater valve and adapted for receiving one of said pair of substantially similar off-on pneumatic signals from said repeater valve; and a pair of logic elements connected to said repeater valve and said divider valve, said logic elements arranged to selectively shift said divider valve between said first position and said second position only as said repeater valve shifts from its first position to its second position, output flow from each of said logic elements provides a signal input to itself through said divider valve, whereby said logic element is maintained in its flow position until output flow terminates, said divider valve being maintained in a fully shifted position by said output flow;

a plurality of metering valve assemblies, each of said assemblies including:

a. a metering valve having an inlet and two outlets, saidd metering valve adapted for generating a pneumatic signal in response to each shift of said divider valve, said metering valve also adapted for shifting between a first position and a second position;

b. a first and second fluid cell connected to said metering valve, said first fluid cell being periodically communicated to said inlet of said metering valve and second fluid cell being periodically communicated to one of said outlets of said metering valves during first metering valve position and first fluid cell being periodically communicated to the other outlet and second fluid cell being periodically communicated to said inlet during second metering valve position, whereby a second pair of on-off pneumatic signals is projected from said outlets;

c. an integrator attached to said metering valve, said integrator smoothing the second pair of on-off pneumatic signals from said metering valve and producing a rate pressure representative of the rate of movement of said pump, said integrator comprising (i) a line connector having two inlets and one outlet, said inlets attached to said metering valve outlets, and (ii) a flow restrictor attached to said outlet of said line connector;

a plurality of relay assemblies connected to said metering assemblies, for supplying a pneumatic fluid having a pressure in excess of said rate pressure, each of said relay assemblies includes (a) a venting restrictor connected to one of said metering valve assemblies, said venting restrictor arranged to controllably discharge said rate pressure; (b) a first bias relay interposed between one of said metering valve assemblies and a third remote fluid supply, said first bias relay adapted for supplying to said metering valve assembly a pneumatic fluid having a pressure in excess of said rate pressure; (c) a second bias relay connected to said metering valve assembly and a third remote pneumatic fluid supply, said second bias relay adapted for supplying a second pneumatic fluid having a pressure in excess of said rate pressure; (d) a gauge restrictor connected to said second bias relay, said gauge restrictor adapted for smoothing said second pneumatic fluid having a pressure in excess of said rate pressure;

a plurality of pressure gauges attached to said gauge restrictor, said pressure gauges selectively responsive to changes in said second pneumatic fluid.

* * * * *